US006474390B1

(12) United States Patent
Vandevoorde

(10) Patent No.: US 6,474,390 B1
(45) Date of Patent: Nov. 5, 2002

(54) MACHINE FOR PLACING LABELING SLEEVES ON BOTTLES

(75) Inventor: Jean-Claude Vandevoorde, Montdidier (FR)

(73) Assignee: Protection Decoration Conditionnement Europe S.A., Montdidier (FR)

( * ) Notice: Subject to any disclaimer, the term of this patent is extended or adjusted under 35 U.S.C. 154(b) by 0 days.

(21) Appl. No.: 09/395,069

(22) Filed: Sep. 13, 1999

(30) Foreign Application Priority Data

Sep. 14, 1998 (FR) ..... 98 11422

(51) Int. Cl.[7] ..... B65C 9/00; B65C 3/06; B65C 3/08

(52) U.S. Cl. ..... 156/494; 156/556; 156/567; 156/568; 53/585

(58) Field of Search ..... 156/494, 495, 156/496, 362, 568, 556, 566, 567, DIG. 8; 53/399, 585, 582, 589, 590

(56) References Cited

U.S. PATENT DOCUMENTS 3,959,065 A * 5/1976 Ashcroft ..... 156/423
4,412,876 A 11/1983 Lerner et al.
4,496,409 A * 1/1985 Kontz ..... 156/85
4,944,825 A * 7/1990 Gifford et al. ..... 156/294
5,259,913 A 11/1993 Stover
5,326,422 A 7/1994 Kronseder
5,417,794 A * 5/1995 Menayan ..... 156/362
5,483,783 A * 1/1996 Lerner et al. ..... 53/399

FOREIGN PATENT DOCUMENTS

EP 0 584 516 7/1993 ..... B65C/3/06
EP 0 654 410 11/1994 ..... B65C/3/06

* cited by examiner

*Primary Examiner*—Richard Crispino
*Assistant Examiner*—Sue A. Purvis
(74) *Attorney, Agent, or Firm*—Randall J. Knuth

(57) ABSTRACT

A labeling machine having an input station receiving the bottles on which a sleeve is to be placed, a station for dispensing sleeves from a sheath and a main turret fitted with units for receiving the bottles and a providing them with a sleeve. Each unit has a slidable tool mounted parallel with the bottle to place the sleeve on the bottle. The main turret is suspended from a tripod supported directly on the ground while the input and output turrets as well as the unreeling station supplying the sheath dispensing the sleeves are supported by the machine frame.

7 Claims, 9 Drawing Sheets

MACHINE FOR PLACING LABELING SLEEVES ON BOTTLES

BACKGROUND OF THE INVENTION

1. Field of the invention

The present invention relates to a machine for placing labeling sleeves on bottles, comprising an input station receiving the bottles on which a sleeve is to be place, a sleeve dispensing station, fed with a continuous sheath of sleeves, for separating the sleeves, a main turret fitted with units for receiving the bottles distributed regularly around the periphery of this turret, for receiving the bottles transferred by the input station as well as the sleeves to be placed on the bottles as they are rotated on the main turret, an output station taking the bottles fitted with their sleeve from the main turret in order to discharge them, as well as a control system managing operation of the different machine components.

2. Description of the related art

Numerous types of machines for applying labels are available. Their general characteristic is their complexity and, accordingly, their lack of reliability. Furthermore, re-setting a machine to switch from handling one type of bottle or one type of sleeve to another is a relatively lengthy operation.

SUMMARY OF THE INVENTION

An objective of the present invention is to overcome these disadvantages and it is proposed that a machine for placing stretchable sleeves on bottles be improved, making it simple to build and to install, reliable in operation and allowing sleeves to be placed on the bottles reliably and with high-precision positioning while enabling the machine to be adapted rapidly to a change of program (different sleeves or different bottles).

In one embodiment of the present invention, a machine of the type defined above, is characterized in that each receiving unit comprises a support receiving bottle; a unit with two suction arms to pick up a sleeve from the dispensing unit and to open the sleeve by moving the two arms apart; a slidable tool mounted parallel with the bottle, the displacement of which relative to the bottle is controlled by a roller which bears on an adjustable cam for receiving the sleeve into stretching devices borne by the two suction arms, taking the sleeve by its two sides located in the peripheral direction by means of the two stretching devices which are controlled so as to move the sides apart, and lowering it so as to place it on the bottle, the top of the sleeve being fixed onto the bottle and the tool being released from the bottom of the space between the bottle and the sleeve; a coupling device for receiving the tool by means of a mechanical hooking link, the control connections of the stretching devices being simultaneously established.

Another embodiment of the present invention comprises the unreeling station receiving a sheath of sleeves which are printed but not separated, having a cutter with a blade and counter-blade to cut off each sleeve at its junction with the subsequent sleeve.

Yet another embodiment of the present invention comprises a cam for controlling the travel of the tool as it is lowered relative to the bottle while the main turret is being rotated and, in a final phase of lowering the sleeve onto the bottle, a relaxation level for the sleeve so as to allow the sleeve to be relaxed, the top thereof being retained on the bottle and the bottom being held taut be the stretching devices, then controlling the opening of the tool to release the bottom edge of the sleeve and finally enabling the release of the tool as it is lowered below the bottom edge of the sleeve placed on the bottle.

The machine proposed by the invention has the advantage of being very simple in design as regards the main turret comprising the receiving units fitted with extremely simple means which can be mounted very easily and very rapidly. The fact that there are separate means for picking up the sleeve to position it with a view to placing it on the bottle, i.e., the two suction arms and the tool which applies the sleeve, offers a large degree of flexibility with regard to operation because even though the tool has to be changed to suit the dimensions of the bottle and those of the sleeve, the same does not always apply to the suction arms which may be common to several types of tool. Fitting the tool itself by means of a coupling, which allows a simple hooking action followed by locking to establish not only the mechanical link between the tool and the main turret but also the connection for fluids (compressed air) offers a solution of considerable practical interest.

Finally, controlling the lowering of the tool, i.e., the stretching devices, by placing the sleeve around the bottle and allowing the sleeve to relax after a first positioning phase, comprises essentially of setting the upper part of the sleeve in place as it elastically tightens around the designated place for the sleeve and then gradually shifting to a state in which the sleeve is in equilibrium, guarantees that the sleeve will be accurately and firmly positioned and will not be disturbed as the tool, i.e., the stretching device, is extracted at the end of this phase of relaxing the sleeve. This relaxation phase can be adjusted by the length of the cam up to the moment when the clamp releases the bottom edge of the sleeve allowing the front surface of the stretching device to be extracted. Since the fixed cam preferably consists of two parts, one being adjustable relative to the other, this adjustment will be made by means of an actuator at the time when the format is changed. This actuator will simply cause one of the parts of the cam to pivot, generally the part corresponding to the horizontal branch, i.e., that of the relaxation phase, depending on the length needed for the relaxation process. The lowering action of this horizontal part of the cam will depend on the lowering movement required of the tool to slip on the sleeve. This lowering movement will preferably be effected along a ramp retaining the same inclination.

Another advantage of the present invention includes the stretching devices comprising a front plate and a rounding plate, the front plate being of a shape matching that of a part of the bottle contour and the guide surface, controlled in translation by an actuator, bears a clamp and an actuator thereof, the clamp being applied against the front surface to clamp the bottom edge of a sleeve.

Yet another advantage of the present invention is the fact that the tool is borne by a frame with two stretching devices, symmetrical relative to the plane of symmetry of the tool, this frame bearing a top guide, a bottom guide as well as the jacks of the clamps and the jacks of the stretching devices, these jacks being mounted in series and powered in sequence in order to control a first stretching movement completed by a second stretching movement.

The stretching devices receive the sleeve and position it since the sleeve is supported on the stretching devices by its bottom edge. The stretching devices then clamp the sleeve by means of the clamp co-operating therewith so that the position of the sleeve is accurately defined. This accuracy will be reproduced after the sleeve has been placed on the bottle.

The stretching devices or more generally the tool fitted with two stretching devices is of a very simple design requiring very few control means which include two jacks acting on the two clamps and two jacks controlling the stretching devices as they are moved apart in two steps. This two-step motion is practical because during the first step, the sleeve is opened out, possibly with a certain amount of stretching, and this motion continues until the requisite parting distance has been produced for the sleeve to be positioned. This second movement is controlled when the sleeve arrives above the bottle on which it is to be applied.

It is of particular practical interest to be able to fix the frame onto the main turret rapidly. One particularly advantageous solution used for this purpose is characterized in that the frame has two oblong fixing holes with a hole having a larger passage section to enable hooking onto the hooks of the receiving unit of the main turret, as well as fittings which, when the latter is in place, move onto the ends of the pneumatic pipes supplying the fluid to control the jacks of the tool.

Another advantage of the present invention is the fact that the suction arms are made from a hollow prism-design component of rectangular section, terminated at the front by an offset section provided with a suction pad connected to the body by a bellows, these suction arms slidable engaging in recesses of a section matching the receiving unit.

This construction of the suction arms makes them easier to replace since they merely need a sliding action, optionally incorporating a locking action.

In a manner that is of particular advantage with regard to the design and installation of the machine, the main turret bearing the receiving units is suspended from a tripod frame with three legs supported on the ground.

Suspended in this manner, the main turret is not affected by any movements of the frame bearing the other equipment of the machine such as the input and output turrets and the sheath-feeding device. Since these auxiliary means are located at the periphery of the main turret, they can be installed without being subjected to the effects of the weight of the main turret. The frame can therefore be limited to a more or less peripheral structure framing the contour of the main turret. The latter is suspended from a tripod, at least two legs of which are adjustable, so that it can be installed directly on the floor covering without difficulty. The plumb is also easy to adjust since this is done independently of installation of the other machine components. Under these conditions, the lower part of the main turret is easily stabilized to prevent any transverse movement. This bottom bearing does not receive any of the turret load.

In a particularly advantageous manner, the station dispensing the sleeves has a cutting device with a fixed counter-blade bearing two guide rails receiving a mobile cutter, the cutting edge of which is inclined relative to that of the counter-blade and, in a rest position, it is above that of the counter-blade, the mobile cutter having a guide cam so that it can be guided underneath the counter-blade to create a cutting action of the scissor type by flexing the blade relative to the counter-blade.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
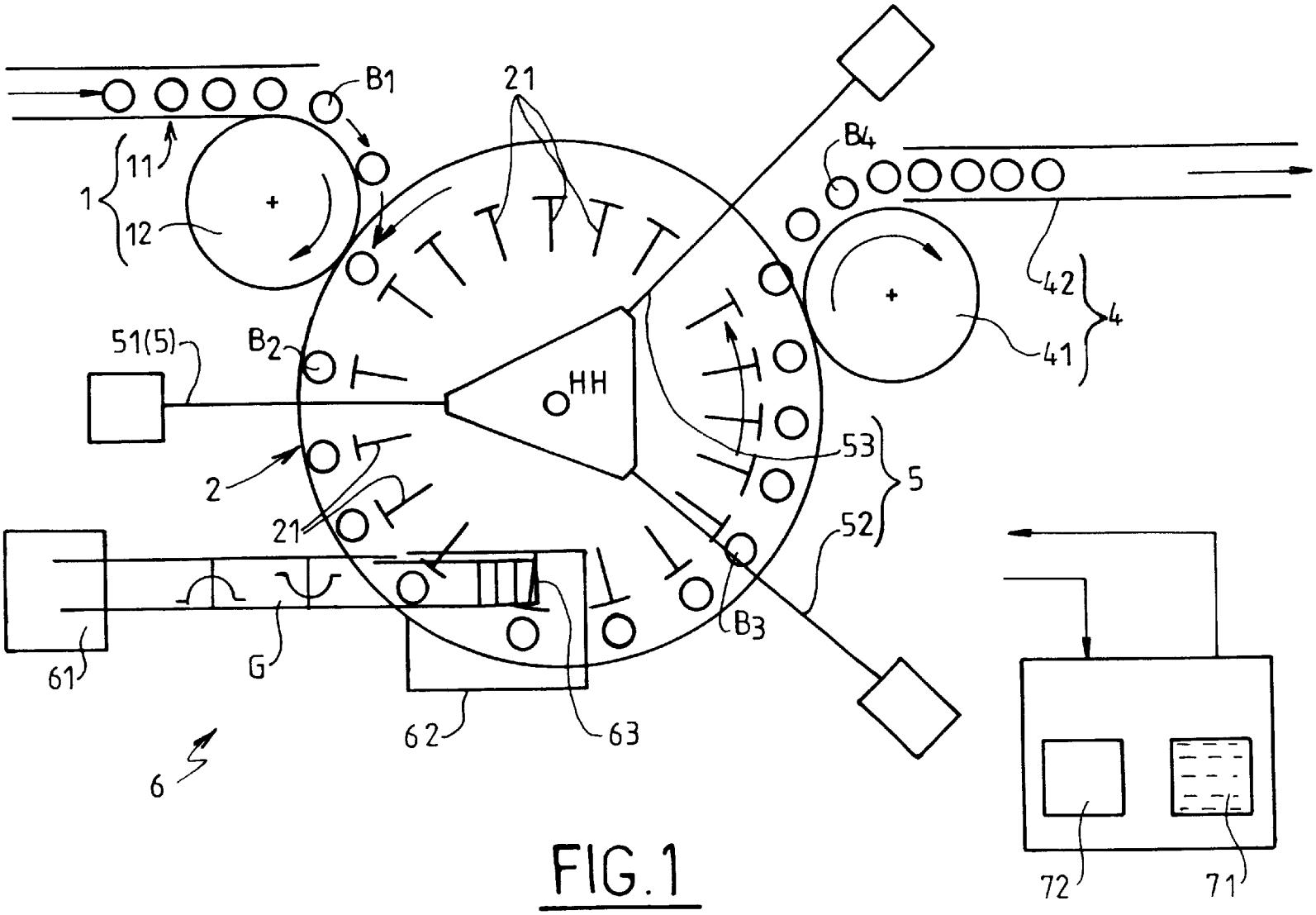
FIG. 1 is a schematic illustration of the machine in a plan view.

FIG. 1 show an embodiment of a machine for placing sleeves, in particular labeling sleeves made from glass or a plastic substance, on bottles. These sleeves are supplied in the form of a continuous sheath, the sleeves being printed and also having a bar code; these sleeves are separated so that they can be placed on the bottles. The sleeves are put into place by a process of stretching if the sleeves are stretchable; after stretching, the sleeves elastically return around the bottle, closing tightly round it; if the sleeve is shrinkable, the sleeve cannot be stretched; before being set in position it will have a section slightly larger than that of the bottle. It is shrunk onto the bottle by a heat-shrinking process.

An example of this type of machine is illustrated in FIG. 1. It is made up of an input station 1 having a linear incoming conveyor 11 supplying a main turret 2 by means of an incoming star system 12. The incoming star system 12 is a drum, which may or may not be provided with clamps which pick up the bottles B1 one by one at the output of the incoming conveyor 11 in order to position them in receiving units 21 of the main turret 2. The main turret 2 is a cylinder rotating about a vertical shaft. At its periphery, the turret is provided with receiving units 21, illustrated schematically in FIG. 1 and in more detail in FIGS. 2, 3 and 4. Each of these receiving units 21 receives a bottle B2 on which it will place a sleeve as the turret rotates (in continuous motion). At the output of the main turret 2 is an output station 4 made up of an output star system 41 generally similar to the incoming star system 12 and an output conveyor 42. The output conveyor 42 is a linear conveyor and the output star system is a rotating drum provided with clamps at its periphery, which are not illustrated in detail. Each of these clamps picks up a bottle from a receiving unit on the main turret so as to pass it across to the output conveyor.

The main turret 2 is suspended from a tripod 5, the three legs 51–53 of which are supported directly on the ground. At least two of the three legs are adjustable to enable the axis of rotating HH of the main turret 2 to be adjusted. At its bottom end, the shaft of the main turret 2 is simply retained but not supported.

The machine has a station for supplying sleeves 6. This station, illustrated schematically, is made up of a reserve of sleeves 61, i.e., a roll of sheaths of a certain length with the sleeves imprinted on it but not separated from one another by a tear-off. This sheath G is guided into the unreeling station 62 which positions each sleeve exactly by making the corrections needed to take account of any slipping of the sheath or sleeve in the driver device so as to cut the sleeve when the sleeve is separated in the cutting device 63. The sleeve is picked up by a receiving unit 21 in readiness for positioning on the bottle B2 already placed in this unit.

The machine is provided with a control station 7, which has in particular a keyboard 71 and control screen 72 enabling data to be entered such as the settings for the sleeves and bottles (sleeve format and bottle dimensions) as well as quantitative data such as the quantities of bottles to be processed.

This control station also handles the machine automation and in particular synchronization of the different motors or drive means, label cutting and the control thereof.

Figure 2:
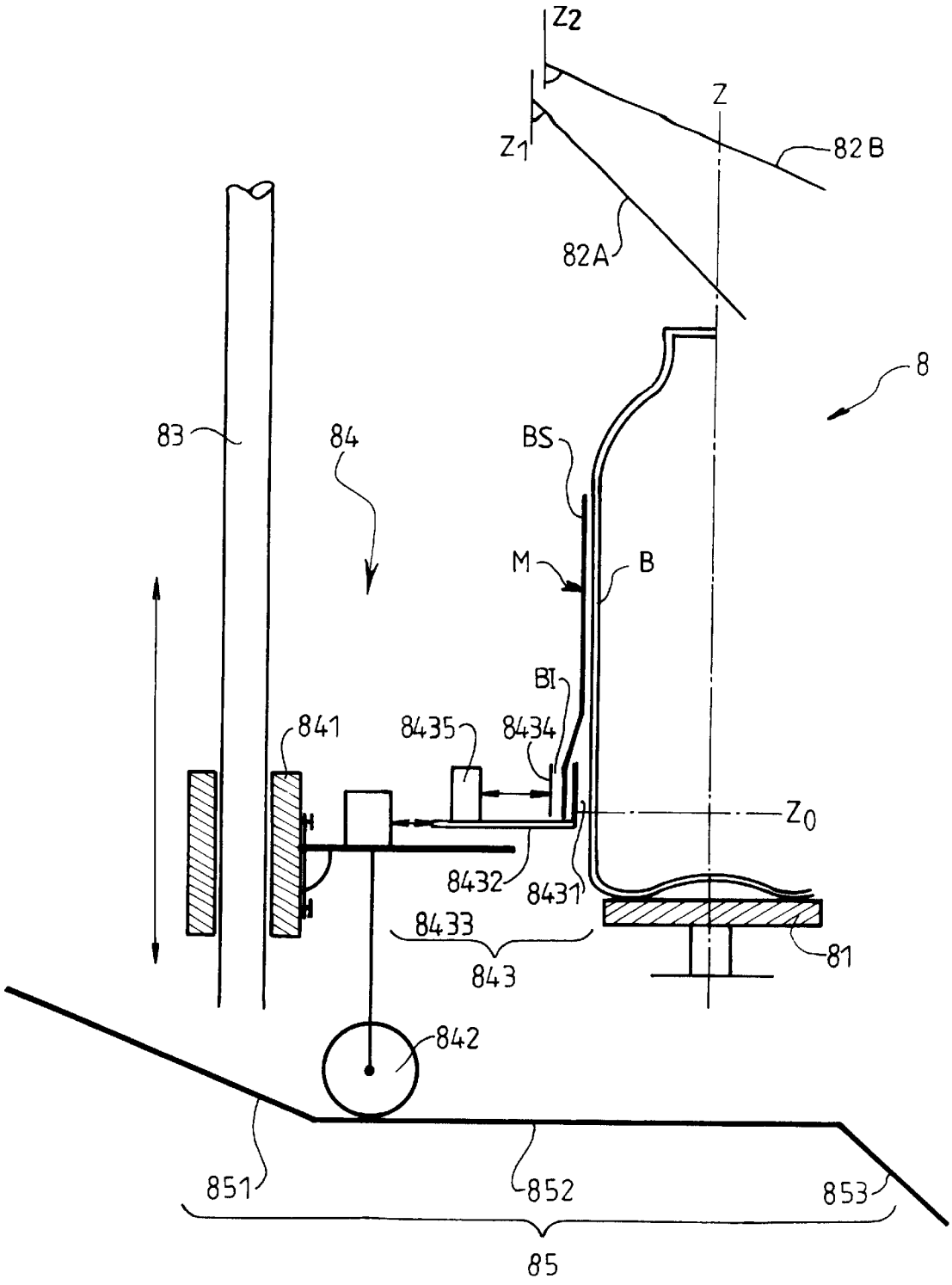
FIG. 2 is a partial side view of a tool of a receiving unit with the cam controlling the tool.

FIG. 2 is an operating diagram of a receiving unit 8. This receiving unit 8, joined to the main turret in rotation by means which are not illustrated, consists of a support 81 in the form of a plate receiving the bottle B. This plate 81 is horizontal and the axis of the bottle which is partially illustrated is shown by reference ZZ. The receiving unit 8 also has a unit comprising two suction arms 82A, 82B, pivotally mounted on the turret and connected, by means not illustrated, to a vacuum source. These two arms 82A, 82B are able to pivot relative to one another about a certain angle in order to pick up sleeves at the output of the sheath-unreeling station when the sleeve has been out above the tool. These arms are mounted at a fixed height but may also be mounted so as to be vertically movable so as to move upwards, pick up the sleeve as it arrives at the top (sleeve not illustrated) and move it across on the tool.

The receiving unit 8 has a vertical guide pin 83 (or two pins), on which the tool 84 is able to slide. This tool 84 comprises a block 841 sliding on the pin and a roller 842 rolling on a stationary, peripheral cam 85 controlling the raising and lowering of the tool 84.

The tool 84 has two stretching devices, only one 843 of which is illustrated and then only very schematically; the stretching device 843 comprises a front surface 8431 and a guide plate 8432; it is controlled in translation by an actuator 8433 such as a pneumatic jack.

The guide surface 8432 bears a clamp 8434 and its actuator 8435. The clamp 8434 can be moved close against the front surface 8431 so as to clamp the bottom edge BI of a sleeve M against it.

FIGS. 2A, 2B, 2C, and 2D are very schematic illustrations of the different steps involved in placing a sleeve M on a bottle B. In each case, these drawings show only half of a bottle and half of a sleeve and, very partially, the stretching device and its clamp.

Figures 2A, 2B, 2C, 2D, 2E:
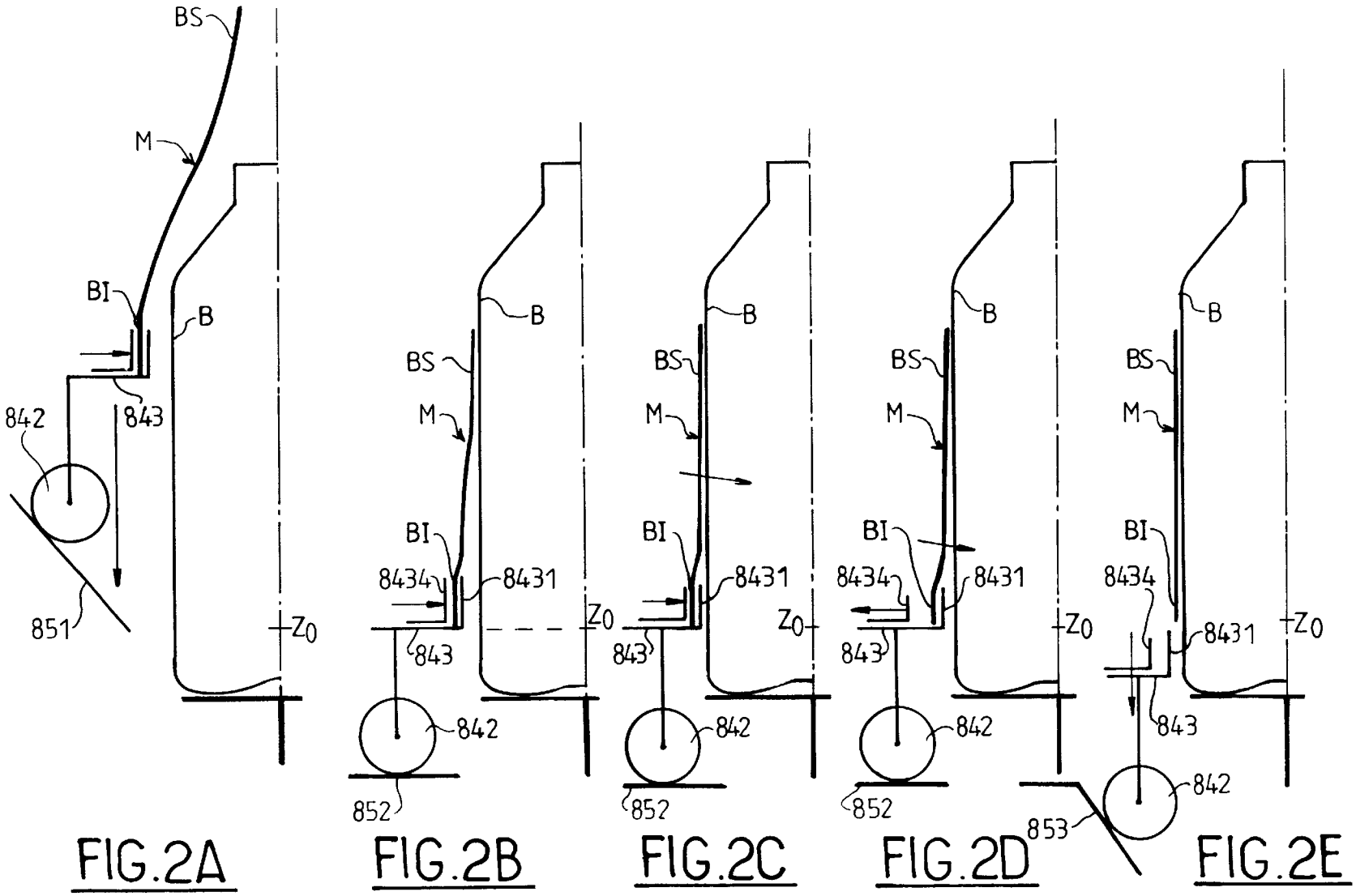
FIGS. 2A–2E show the different steps involved in placing a sleeve on a bottle, these drawings showing only one stretching device and one half of the bottle.

In FIG. 2A, the stretching device 843 has picked up the sleeve M. It is clamped by its bottom edge BI. The two stretching devices 843 open the sleeve out, stretching it so as to pass it over the top of the body of the bottle B. The sleeve, as illustrated in FIG. 2A, is only stretched on a level with the two stretching devices. Since this is a stretch sleeve, i.e., elastic, it is stretched at its bottom part BI only, while the top part BS is not widened. This effect is used to slide the sleeve from the top over the top of the bottle B. This movement is a lowering movement controlled by the part 851 of the cam 85.

As seen in FIG. 2B, when the stretching device 843 (i.e., the bottom edge of the sleeve BI) is lowered as far as the height 20, which represents the reference position for the bottom edge BI of the sleeve M, the stretching device 843 is halted. The end of the movement by which the sleeve M is positioned corresponds to the point at which the roller 842 reaches the horizontal part 852 of the ramp 85. The sleeve is applied against the bottle B5 at least on a level with its top edge, the remainder being slightly spaced back due to the traction exerted by the stretching device 843, still clamping the edge of the sleeve.

As illustrated in FIG. 2C, the sleeve is gradually applied against the exterior wall of the bottle B until it is finally applied against the entire wall except for the point at which the stretching device 843 is located. In effect, the position of extreme closeness of the stretching device relative to the bottle still leaves a certain operating distance to take account of any deformations in the bottle, preventing any risk of the stretching device touching the exterior wall of the bottle.

In FIG. 2D, after this period of relaxation, a command is issued to open the clamp 8434, thereby releasing the bottom edge BI of the sleeve M, the front surface 8431 of the stretching device still being between the bottom edge BI of the sleeve and the corresponding wall of the bottle B. At this instant, the sleeve M has retained its equilibrium and is firmly applied against the exterior surface of the body of the bottle across a sufficiently large height to ensure that the resultant friction forces between the sleeve M and the body of the bottle B will be significantly greater than the force exerted by the stretching device 843, the front surface 843A of which is released, by lowering the sleeve (FIG. 2E). During this lowering movement, the bottom edge BI of the sleeve M returns elastically against the body of the bottle B. The sleeve has now been completely positioned. The downward movement of the stretching device 843 is controlled by the downwardly sloping part 853 of the ramp 85 in front of the horizontal part 842.

Figure 3:
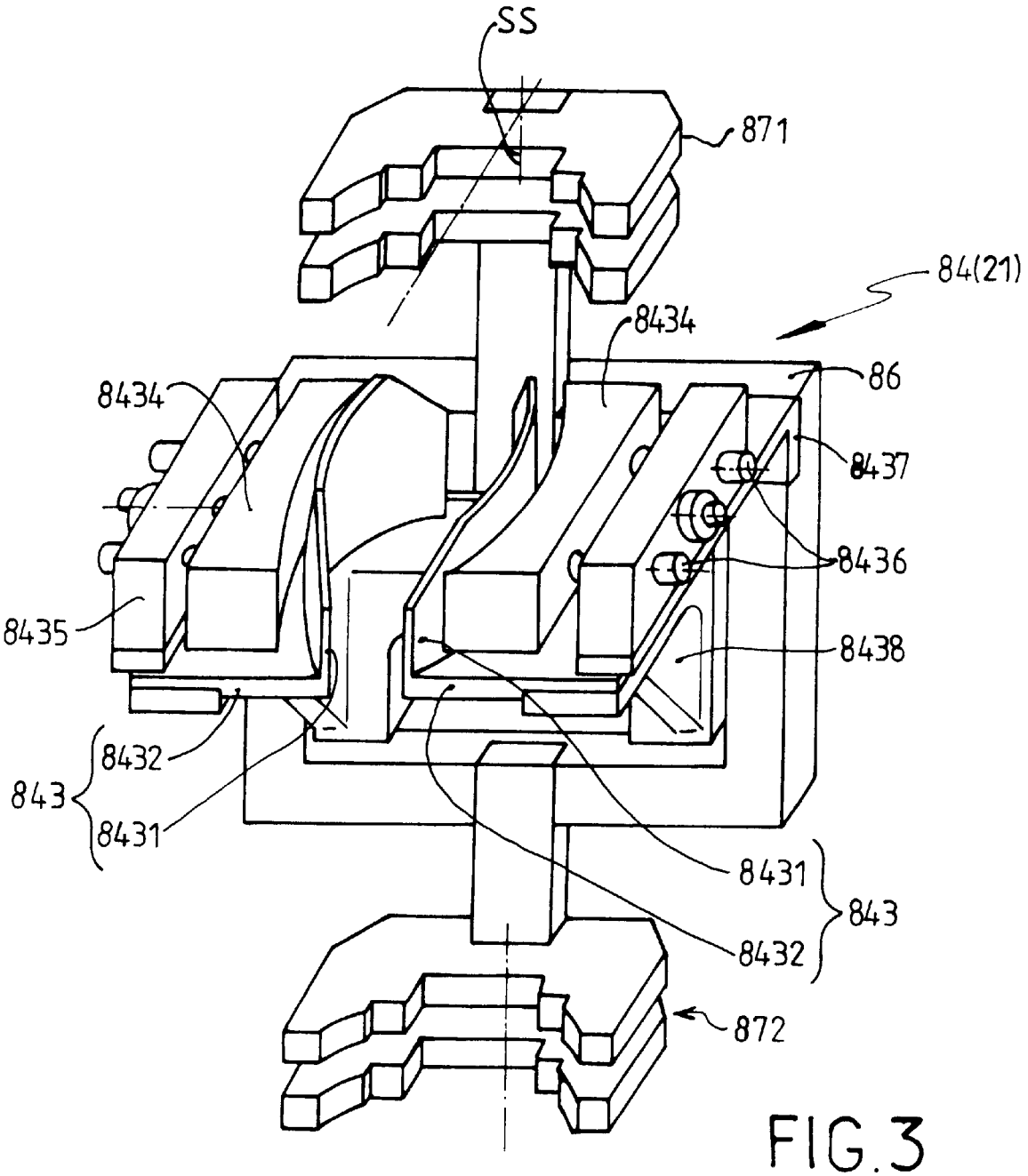
FIG. 3 is a perspective front view of the tool.
Figure 4:
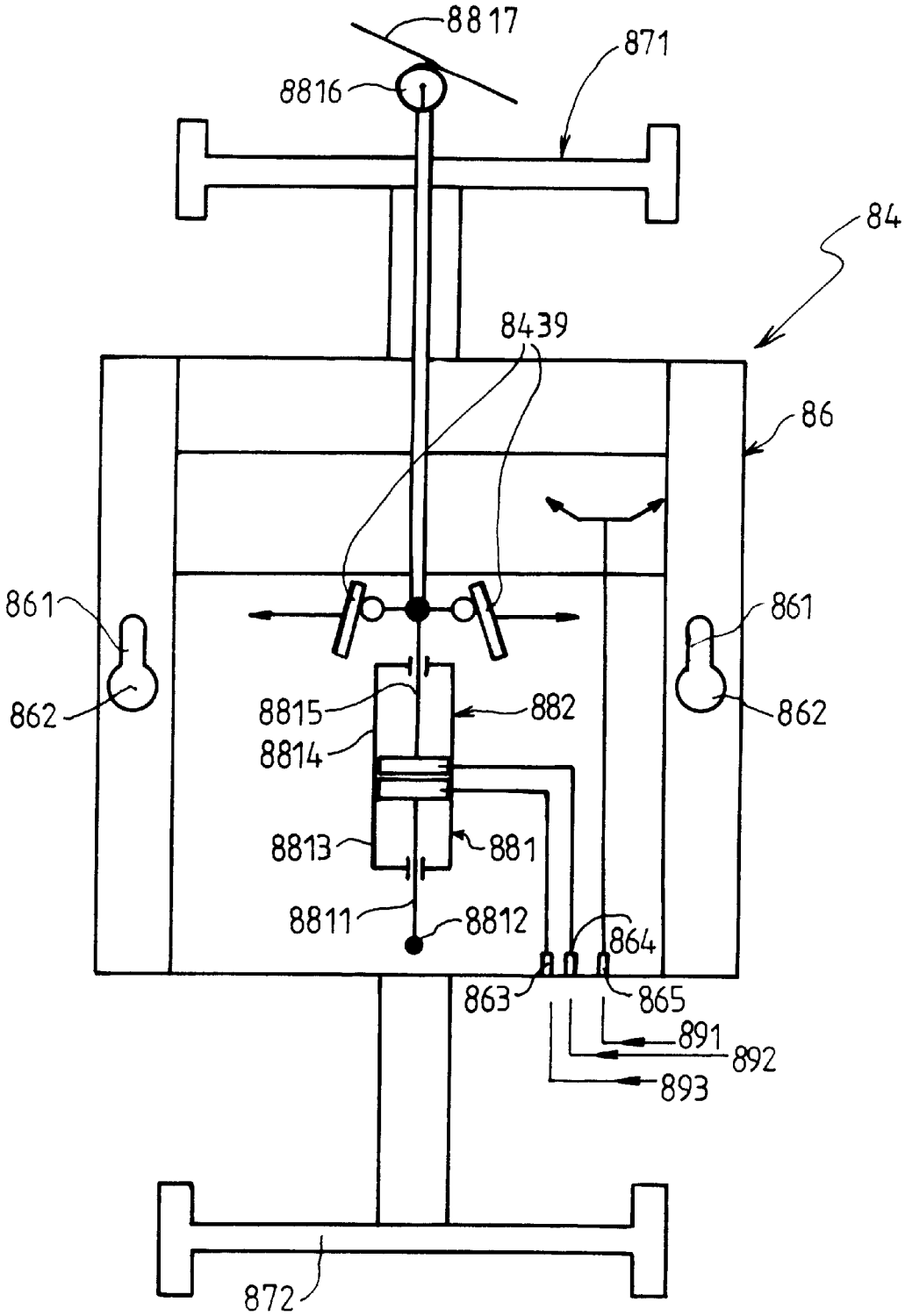
FIG. 4 is a rear view of the tool illustrated in FIG. 3.

FIGS. 3 and 4 illustrate an embodiment of a tool 84 in more detail. This tool consists of two stretching devices 843, symmetrical relative to the plane of symmetry SS of the receiving unit 21. These two stretching devices are shown by the same references. Each stretching device comprises a front plate 8431 of curved shape, for example a circular cylindrical shape, matching the shape of the bottle on which a sleeve is to be placed. On its guide plate 8432 by means of a support block 8435 forming a jack, the stretching device bears a clamp 8434, the curved shape of which matches the curved shape of the front plate 8431 so as to be able to clamp, in the space, the matching part of the bottom edge of a sleeve. The clamp 8434 is guided in the guide block by two pins 8436. The movement of the clamp is controlled by a pneumatic jack.

The two stretching devices and their clamps for the bottom edge of the label are arranged substantially symmetrically relative to the median plane SS of the tool 84.

As already mentioned, the clamp 8434 is movable relative to the front plate 8431; the two stretching devices can in turn be displaced in lateral translation so that the two front plates 8431 can be moved close enough together to receive the sleeve when it is slightly open but not stretched by the suction arms. The guide plates 8431 have a guide edge 8437 slidably mounted in a frame 86 as well as a bracket 8438 bearing cam 8439 (FIG. 4) designed to co-operate with the actuators.

The frame 86 bearing the two stretching device 843 and their clamps 8434 is provided with two oblong holes 861 with a passage hole 862 with an enlarged section so that it can be hooked on two hooks (not illustrated) of a matching shape, borne by the receiving unit of the main turret. This hooking means provides a fast mounting/dismantling arrangement. The large holes of the oblong holes merely have to be passed over the head of the hooks and the frames lowered under the effect of their own weight so that the body of the pins of the hook move into the oblong hole, thereby holding the frame. A simple locking means such as a latch prevents any reverse translation (not illustrated).

In its extension, the frame 86 also bears a top guide 871 and a bottom guide 872 dependent on the shape of the bottle. The bottom guide 872 firstly moves around the bottle when the tool 84 is lowered relative to the bottle in order to set the sleeve in place and then, depending on the circumstances, the top guide 871 holds the bottle from the top when the tool is in the final position, having set the sleeve in place, and in particular while the stretching devices are being extracted once the sleeve has been relaxed (FIG. 2E).

As illustrated in FIG. 4, which shows the rear of the tool, in addition to the two control jacks 8435 of the clamps 8434, the tool has two actuators consisting of two jacks 881, 882 to control a two-step opening movement of the stretching devices with their clamps.

To this end, the first jack 881 has a piston rod 8811 which is linked to the frame 86 at a fixed point 8812 and the cylinder 8813 slides vertically as the jack is filled with the control fluid (compressed air). In the extension of this first jack 881, there is a second jack 882, the cylinder 8814 of which is joined to the cylinder 8813 of the first jack, and its piston rod 8815 controls the two ramp cams, which are preferably symmetrical, borne by the transversely sliding stretching devices.

When the first jack 881 is powered, the unit comprising the two cylinders 8814, 8815 and then the rod 8815 of the second jack, whose piston is applied to the base of its cylinder, is raised during the first course of travel defined by this first jack 881. By means of the cam 8439, this raising movement controls a certain transverse displacement moving the two stretching devices apart (first stretching movement). Then, when the chamber of the second jack 882 is supplied (that of the first remaining supplied), this movement deploys the second jack, which controls the second phase of the moving the stretching devices 843 apart.

The two jacks 881, 882 are supplied by connector fittings borne by the frame. In addition to the supply to these two single-acting jacks, there is also a common supply to the two jacks 8435 of the clamps 8434, which is also provided via a fitting 864 (the jacks of the clamps are also single-acting jacks).

The three hydraulic pipes 891, 892, and 893 are connected simply by locating them on the end of supply tubes provided with appropriate sealing means; this fitting is set up at the same time as the frame 86 is hooked onto the coupling means comprising two hooks which serve to position the receiving unit 21 of the main turret 2 correctly; the connections are automatically established as the frame 86 is lowered under the effect of its own weight.

Conversely, when the frame 86 is release, the connections are dismantled without the need for any specific intervention (the general supply of compressed air is cut off at the time when the tool is being changed).

As mentioned above, the tool 84, i.e., the unit comprising the two stretching devices 843, the shape of the front plates and clamps as well as the shape of the top and bottom guides and the position of these guides will depend on the format of the bottle to be processed as well as the format of the sleeve to be placed on this bottle. These tools are fitted to suit the work to be carried out. In order to process a bottle or sleeve of a different format, the tools 84 on the main turret 2 are adjustments or certain modifications, such as a change of the suction arms picking up the sleeve or an adjustment to the vertical travel of the tool, for example, to avoid unnecessary travel when processing small bottles or short sleeves, and finally, optionally the relaxation time.

FIG. 4 also illustrates a return roller 8816 borne by the extension of the rod of jacks 881, 882.

Since the jacks are single-acting jacks in order to simplify the structure of the tool system, the stretching devices are returned, i.e., moved towards one another, by mechanically controlling this roller 8816 borne by the top end of the rod 8815 of the jacks, which rolls along the stationary peripheral ramp 8817, located in the upper part on a level with the main turret 2, so that it is lowered enabling the two stretching devices 843 to be moved closer together.

Figure 5:
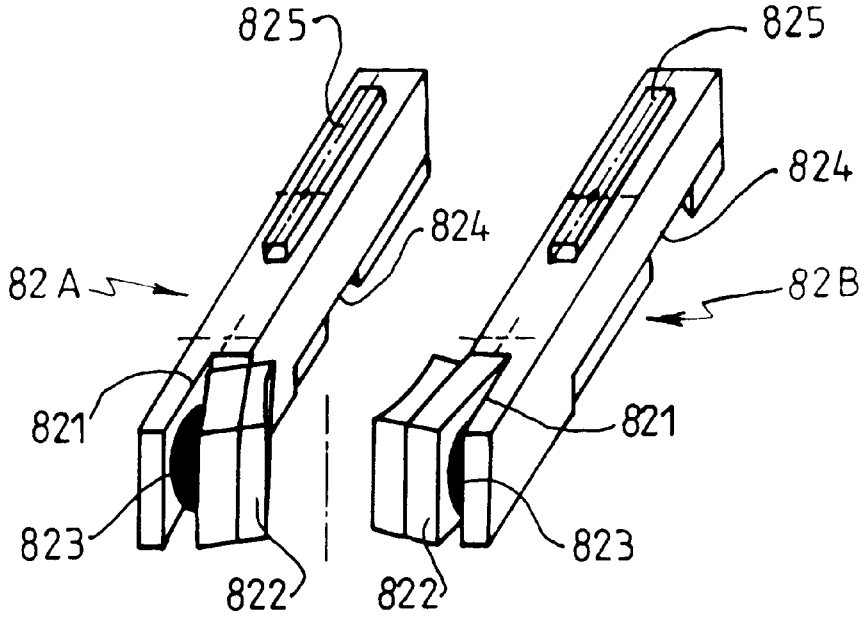
FIG. 5 is a perspective view of two suction arms.

FIG. 5 is a perspective view of two suction arms 82A, 82B. These arms are hollow prisms with a square or rectangular section, terminating with an offset section at the front for receiving a suction pad 822 joined to its arms 82A, 82B in an articulated link, for example, so as to provide some elastic play. This pad 822 has a perforated front surface in order to transmit the vacuum. At the front of the arm, the pad is connected to a sealed bellows 823, allowing a pivoting movement while the body of the suction arm. The top of the arm has a locating pin 825 to ensure that the left and right arms are correctly fitted when the arms are being changed. If the vacuum connection is at the rear, it is possible to provide two identical left and right arms, in which case there will be no need for a locating pin.

The arms are placed in the compartments of the receiving unit simply by locating them in translation and a retaining bolt may be optionally provided. This bolt is not indispensable insofar as the arms operate only in the direction perpendicular to the direction in which they are fitted.

Figure 5A:
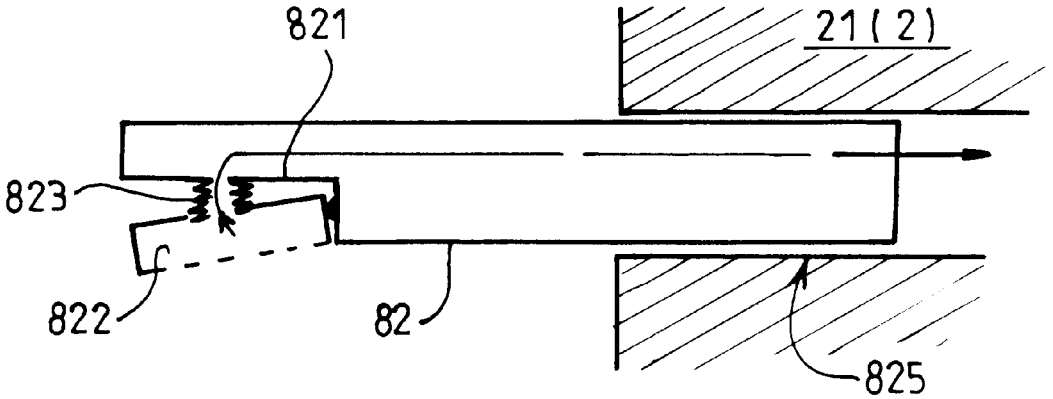
FIG. 5A is a schematic view in cross-section of a suction arm mounted in the receiving unit of the main turret.

FIG. 5A is a schematic illustration in cross-section of an example of an arm 82 placed in its compartment 825.

Figure 6:
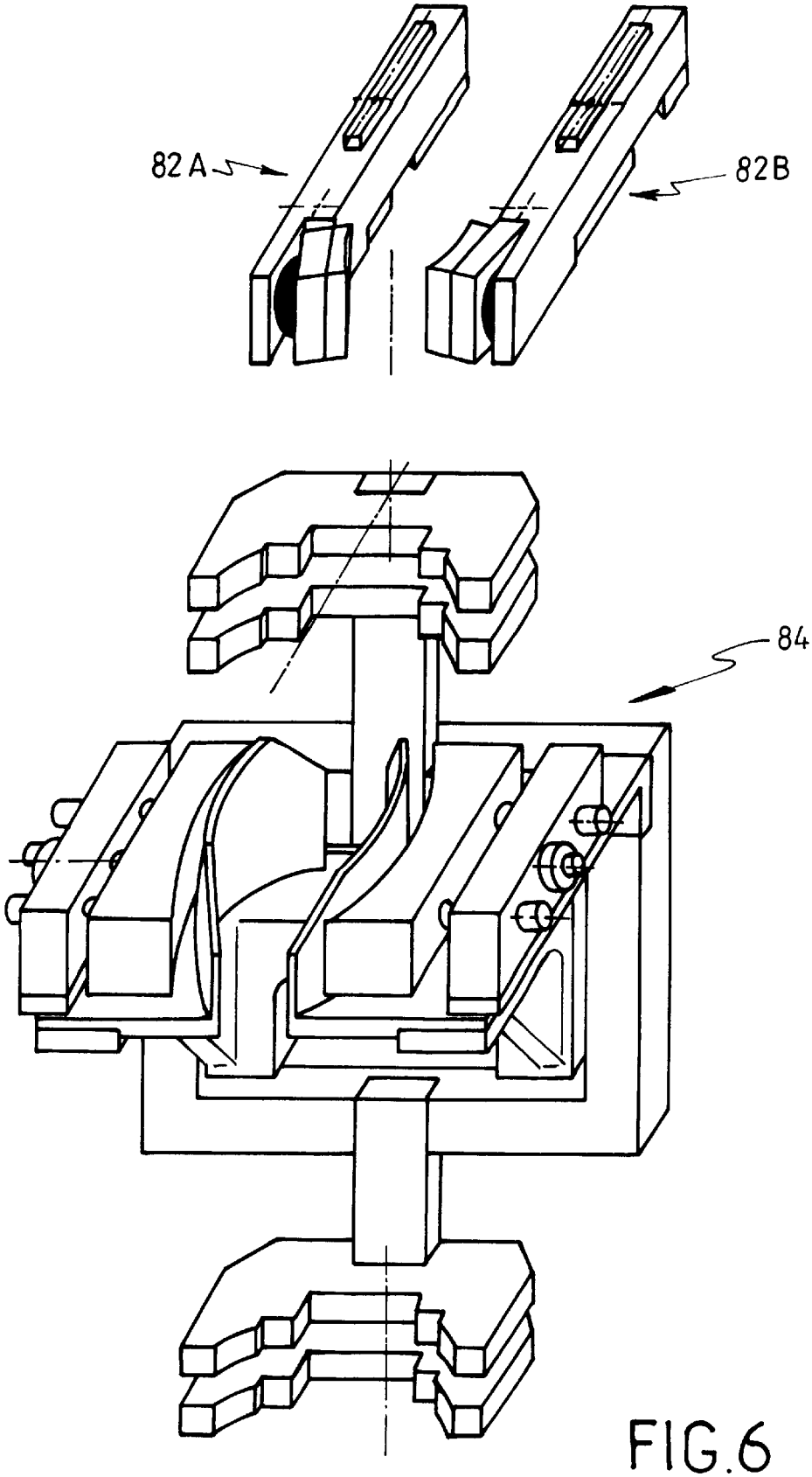
FIG. 6 is a perspective view of the unit comprising the tool and the two suction arms.

FIG. 6 is a perspective view of a tool 84 with the two suction arms 82A, 82B fitted.

Figure 7:
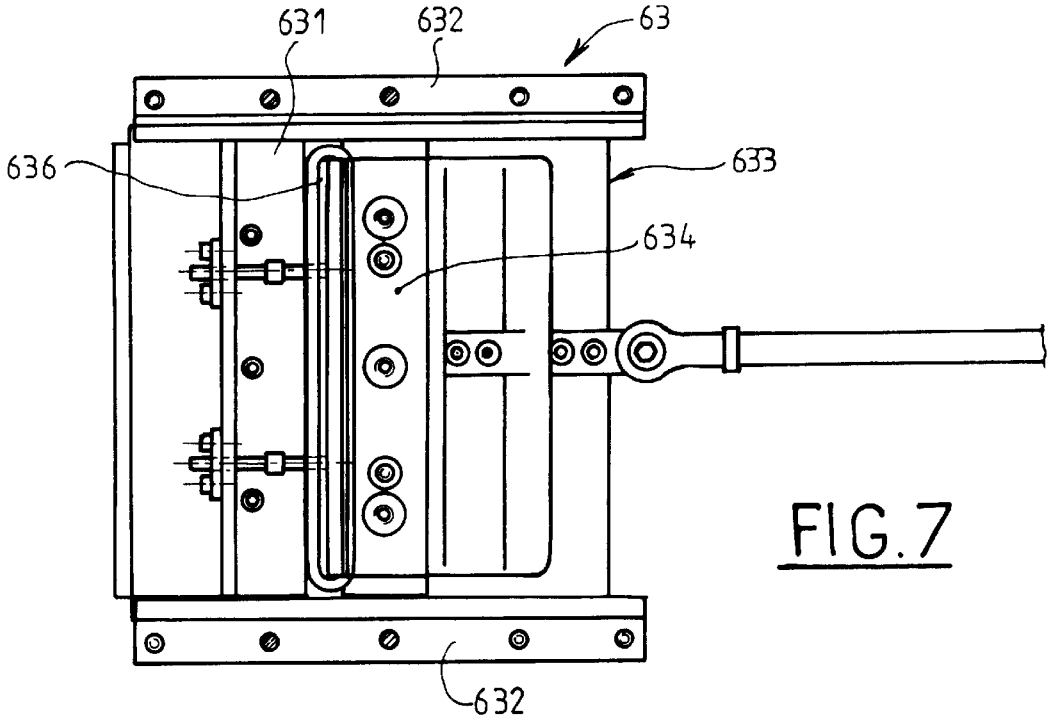
FIG. 7 is a plan view of a cutting device.

FIG. 7 is a plan view of a device for cutting the sleeve 63. This cutting device 63 consists of a stationary counter-blade 631 mounted on two guide rails 632 receiving a carriage 633 bearing a mobile blade 634. This mobile blade 634 is controlled by an actuator such as a pneumatic jack, of which only the control rod 635 is illustrated.

Figure 8A:
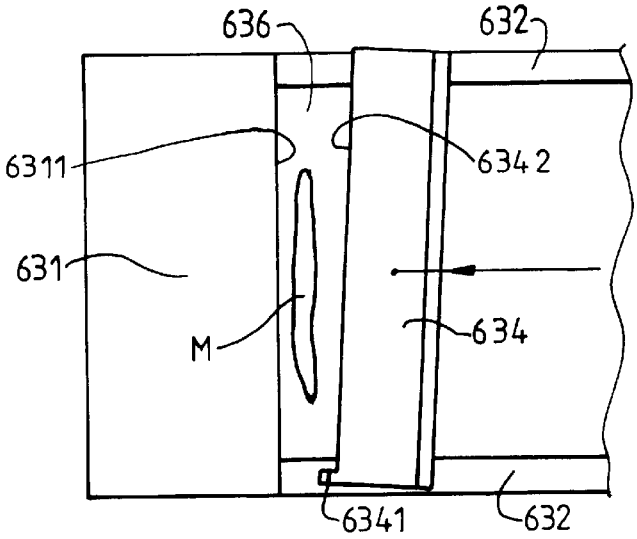
FIGS. 8A–8C illustrate three characteristic steps of an operation in which a sleeve is cut off from the sheath, shown in plan view.
Figure 8B:
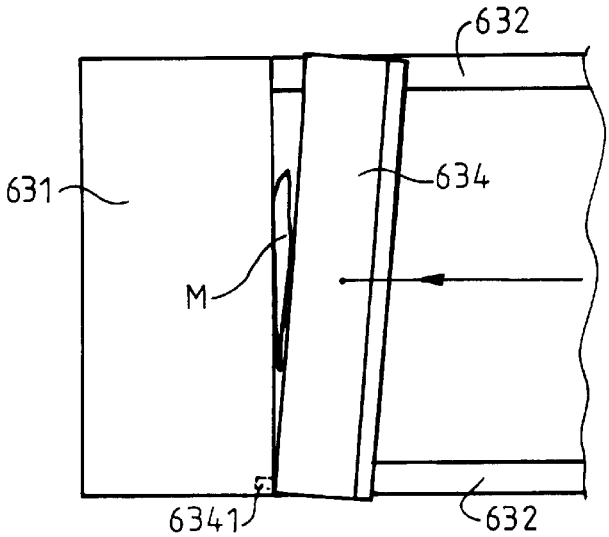
Figure 8C:
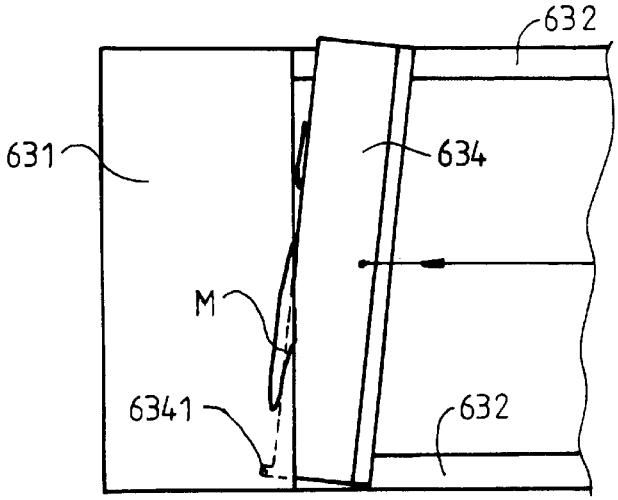

FIGS. 8A, 8B, and 8C provide a schematic illustration in plan view of the steps involved in cutting a sleeve.

Figure 9A:
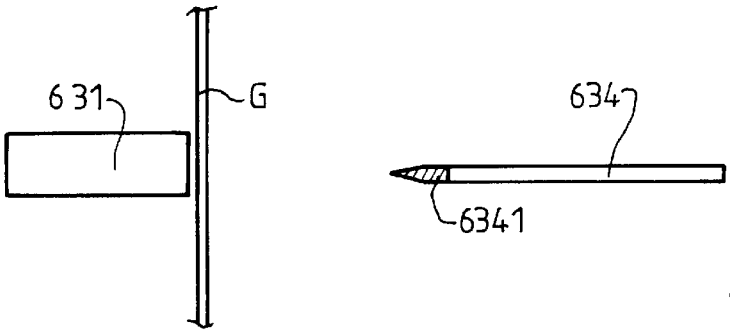
FIGS. 9A–9C are views corresponding to those of FIGS. 8A–8C but from a side view, illustrating the scissor-type cutting action.
Figure 9B:
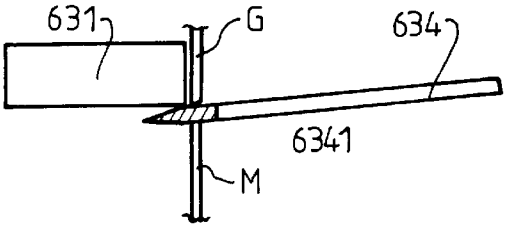
Figure 9C:
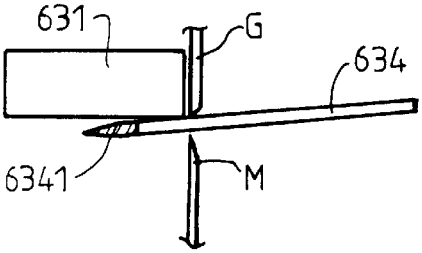

FIGS. 9A, 9B, and 9C are very schematic illustrations with exaggerated deformation, showing the three steps of FIGS. 8A-8C in vertical cross-section.

The sleeve arrives through a guide opening 636 and moves down between the counter-blade 631 and the mobile blade 634 which is in the retracted position. on one side, outside the area across which the sleeve passes, the mobile blade 634 has a cam 6341 enabling the blade to operate in conjunction with the counter-blade in a scissor action. In effect, the cutting edge 6342 of the blade 634 is inclined relative to the cutting edge 634 of the blade is slightly above the surface of the cutting edge of the counter-blade 631 (FIG. 9A). If the blade were to be moved towards the counter-blade without the guide cam 6341, it would abut against the front face of the counter-blade 631.

For the purposes of the invention, the guide cam 6341, which has a ramp-shaped surface (or two surfaces to enable the blade 634 to be reversed) engages underneath the cutting edge 6311 of the counter-blade 631 and causes the blade 634 to yield gradually as the cutting operation progresses so that its cutting edge, which comes into contact with the counter-blade at only one point, is bent and fully applied against the cutting edge of the counter-blade. This produces a scissor action capable of cutting a flexible and sliding material such as a sleeve M.

The specific type of counter-blade 631 and blade 634 renders the blade reversible or even double reversible so as to be able to use two or four cutting edges.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A machine for placing labeling sleeves on bottles, comprising:

an input station having a receiving unit for receiving the bottles on which a sleeve is to be placed;

a sleeve dispensing station fed with a continuous sheath of sleeves, for separating the sleeves;

a main turret fitted with units for receiving the bottles distributed regularly around the periphery of this turret, for receiving the bottles transferred by the input station as well as the sleeves to be placed on the bottles as they are rotated on the main turret;

an output station taking the bottles fitted with their sleeve from the main turret in order to discharge them;

a control system managing operation of the different machine components;

each receiving unit comprising a support receiving a bottle;

a unit with two suction arms to pick up a sleeve from said dispensing station and to open the sleeve by moving the two arms apart, and a slidable tool mounted parallel with the bottle, the displacement of which relative to the bottle is controlled by a roller which bears on an adjustable cam for receiving the sleeve in two stretching devices borne by the two suction arms, taking it by its two sides located in the peripheral direction by means of the two stretching devices which are controlled so as to move the sides apart, and lowering it so as to place it on the bottle, the top of the sleeve being fixed onto the bottle and said slidable tool being released from the bottom of the space between the bottle and the sleeve;

a coupling device for receiving said slidable tool by means of a mechanical hooking link, the control connections of the stretching devices being established simultaneously;

an unreeling station receiving a sheath of sleeves which are printed but not separated, having a cutter with a blade and counter-blade to cut off each sleeve at its junction with a subsequent sleeve; and said cam controlling the travel of said slidable tool as it is lowered relative to the bottle while the main turret is being rotated and, in a final phase of lowering the sleeve onto the bottle, a relaxation level for the sleeve so as to allow the sleeve to be relaxed, the top thereof being retained on the bottle and the bottom being held taut by the stretching devices, then controlling the opening of said tool to release the bottom edge of the sleeve and finally enabling the release of the tool as it is lowered below the bottom edge of the sleeve place on the bottle.

2. A machine as claimed in claim 1 in which said stretching devices comprise a front plate and a rounding plate, said front plate being of a shape matching that of a part of the bottle contour; and a guide surface controlled in translation by an actuator which bears a clamp and an actuator thereof, said clamp being applied against the front plate to clamp the bottom edge of a sleeve.

3. A machine as claimed in claim 2 in which said slidable tool is borne by a frame with two stretching devices symmetrically relative to the plane of symmetry of said tool, said frame having a top guide, a bottom guide, as well as jacks of said clamps and the jacks of the stretching devices, these jacks being mounted in series and powered in sequence in order to control a first stretching movement completed by a second stretching movement.

4. A machine as claimed in claim 3 in which said frame has two oblong fixing holes with a opening having a larger passage section to enable hooking onto the hooks of the receiving unit of the main turret, as well as fittings which, when the latter is in place, move onto the ends of the pneumatic pipes supplying the fluid to control the jacks of the tool.

5. A machine as claimed in claim 1 in which said suction arms are made from a hollow prism-design component of rectangular section, terminated at the front by an offset section provided with a suction pad connected to the body by a bellows, these suction arms slidable engaging in recesses of a section matching the receiving unit.

6. A machine as claimed in claim 1 in which said main turret bearing the receiving units is suspended from a tripod frame with three legs supported on the ground.

7. A machine as claimed in claim 1 in which said unreeling station dispensing the sleeves has a cutting device having a cutting edge said cutting device with a fixed counter-blade bearing two guide rails receiving a mobile cutter, the cutting edge of which is inclined relative to that of the counter-blade and, in a rest position, it is above that of the counter-blade, the mobile cutter having a guide cam so that it can be guided underneath the counter-blade to create a cutting action of the scissor type by flexing the blade relative to the counter-blade.

* * * * *